US006128834A

United States Patent [19]

Vecchiola et al.

[11] Patent Number: 6,128,834

[45] Date of Patent: Oct. 10, 2000

[54] SHOE USING A MOULDED BOTTOM PROVIDED WITH A SERIES OF SLOTS FOR THE APPLICATION OF A STRAP-TYPE CLOSED UPPER

[75] Inventors: Andrea Vecchiola; Nicola Vecchiola, both of Montegranaro, Italy

[73] Assignee: A.K.A Advanced Kit Art S.R.L, Italy

[21] Appl. No.: 09/315,261

[22] Filed: May 20, 1999

[30] Foreign Application Priority Data

May 28, 1998 [IT] Italy ..... AN98U0030

[51] Int. Cl.[7] ..... A43B 3/12

[52] U.S. Cl. ..... 36/11.5; 36/89; 36/50.1; 36/25 R

[58] Field of Search ..... 36/89, 91, 11.5, 36/50.1, 25 R, DIG. 2, 2 A

[56] References Cited

U.S. PATENT DOCUMENTS

| | | | |
|---|---|---|---|
| 2,126,094 | 8/1938 | Daniels . | |
| 2,239,206 | 4/1941 | Tietig . | |
| 2,381,389 | 8/1945 | Riesing . | |
| 2,421,818 | 6/1947 | Tibiletti . | |
| 2,454,181 | 11/1948 | Jordan . | |
| 2,496,782 | 2/1950 | Engel . | |
| 2,583,826 | 1/1952 | Fischer . | |
| 3,251,144 | 5/1966 | Weitzner . | |
| 3,305,947 | 2/1967 | Kalsoy . | |
| 4,458,431 | 7/1984 | Sinclair . | |
| 4,535,554 | 8/1985 | De Obaldia B. | 36/113 |

FOREIGN PATENT DOCUMENTS

| | | |
|---|---|---|
| 2 489 103 | 3/1982 | France . |
| 2 649 593 | 1/1991 | France . |
| 2 009 980 | 10/1970 | Germany . |
| 2 071 481 | 9/1981 | United Kingdom . |

*Primary Examiner*—Ted Kavanaugh
*Attorney, Agent, or Firm*—Leonard Bloom

[57] ABSTRACT

The present invention relates to shoe using a moulded bottom provided with a series of slots on the edges, or with through openings on the sole, for the application of a closed upper, made up of a fabric or leather strap that embraces the back and the neck of the foot.

6 Claims, 2 Drawing Sheets

SHOE USING A MOULDED BOTTOM PROVIDED WITH A SERIES OF SLOTS FOR THE APPLICATION OF A STRAP-TYPE CLOSED UPPER

BACKGROUND OF THE INVENTION

The present patent application relates to a shoe using a moulded bottom provided with a series of slots or openings for the application of a closed upper, made up of a fabric or leather strap that embraces the back and the neck of the foot.

The bottom belongs to the type of moulded bottoms defined as "box" bottom in the footwear industry, which feature a perimeter edge, inside which the upper is sewn and/or glued.

SUMMARY OF THE INVENTION

The shoe according to the present invention originates with the intention of creating a shoe in which the upper, although closed, can be fixed to the bottom without sewing and/or gluing it, since these operations require skilled labour and specific equipment or machinery.

In this perspective a new "box" bottom has been designed with a special configuration, provided with a series of slots or openings on the edge, used to insert one or more straps to embrace or completely cover both the back and the neck of the foot.

In order to guarantee the effective protection of the toes, the bottom incorporates a hollow point, which houses the five toes of the foot, while the back of the bottom incorporates a quite high heel support with slots or opening, in which the strap used to embrace the back of the foot is inserted.

From this general description it can be understood how the shoe according to the present invention can be produced without skilled labour or special equipment or machinery, since the only assembling operation is represented by the introduction of the straps into the slots or openings located in the "box" bottom.

This operation is so simple that it can be even carried out by the purchaser, thus allowing to market the shoe according to the present invention in a kit, with two components: the bottom and the upper, made up of one or more straps.

Finally, it must be noted that the straps are provided with ordinary clips or hook and loop fastener inserts for firm fixing, once the straps have been inserted into the slots or openings and twisted around the foot.

According to the specific requirements, the upper can be made up of several straps, one for each opposite pair of slots, or of one long strap twisted in the opposite series of slots or openings.

In a preferred embodiment of the invention, the opposite series of slots is located on the two edges of the "box" bottom and on the lateral borders of the heel support.

According to an alternative version of the invention, the heel support and the bottom sole feature a transverse series of through openings that end on the two edges of the bottom, in which the straps used to embrace and cover the foot are inserted.

For major clarity the description of the shoe according to the invention continues with reference to the enclosed drawings, which are intended for purposes of illustration and not in a limiting sense, whereby:

DESCRIPTION OF THE PREFERRED EMBODIMENTS

Figure 1:
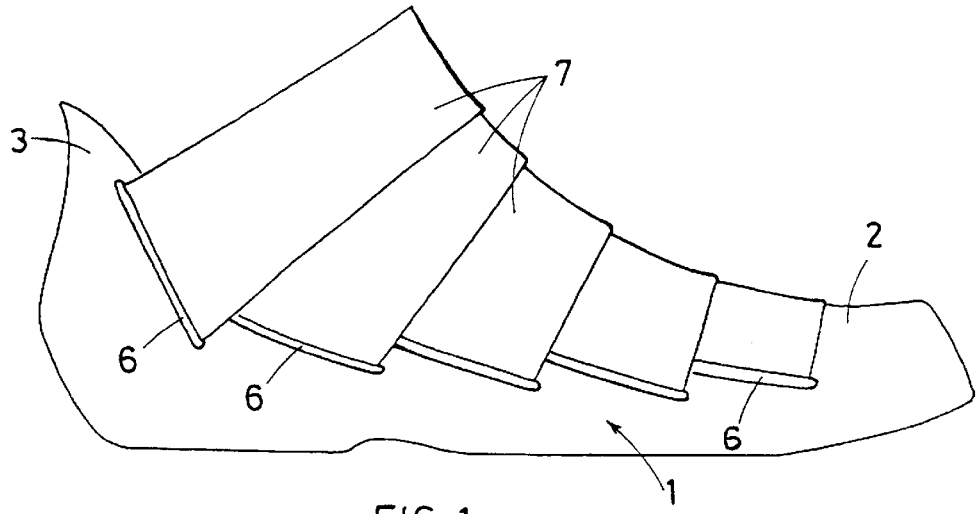
FIG. 1 is a schematic side view of the shoe according to the invention in a preferred embodiment , in which the upper is inserted into two opposite series of slots located on the edges of the bottom and on the sides of the heel support.
Figure 2:
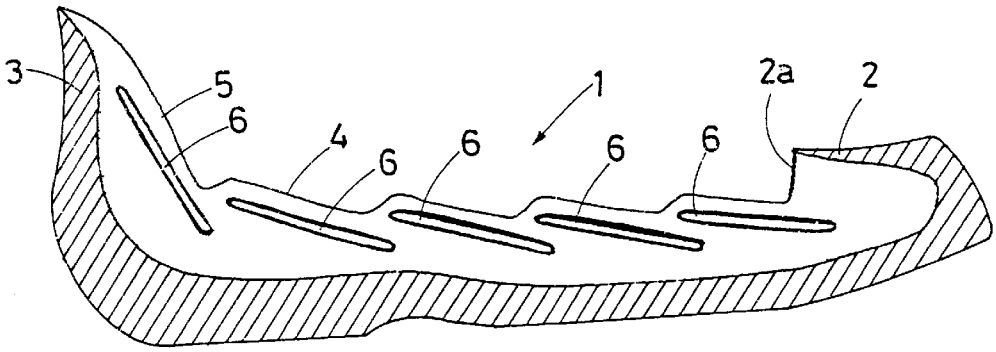
FIG. 2 is a cross-section with a longitudinal plane of the bottom used in the shoe shown in FIG. 1.

With reference to FIGS. 1 and 2, the shoe according to the present invention, in a preferred embodiment, consists of a moulded "box" bottom (1), which features a hollow point (2) and a heel support (3) used to embrace and support the heel up to the height of the malleolus approximately.

Two opposite series of slots (6) are located on the lateral edges (4) of the bottom (1) and on the borders (5) of the heel support (3), characterised in that the back ending section of each slot is located above the initial section of the adjacent slot, going from the point to the heel.

Moreover, the shoe according to the present invention includes an upper made up of one or more straps (7), wide enough to be inserted into the slots (6).

As shown in FIG. 1, also the straps (7), just like the slots (6), are partially overlapped in cascade, so that there no empty spaces can exist between two straps, to avoid leaving the foot uncovered.

On the other hand, the first slot (6), that is the one located next to the point of the bottom (1), begins beyond the opening **(2*a*) of the hollow point (2), so that the opening remains hidden and protected under the first strap (7)**.

Each strap (7) is provided with ordinary clips or hook and loop fastener inserts (not shown in the figure) used to close it.

As already mentioned in the introduction, instead of using a series of straps (7) for each opposite pair of slots (6), a long strap can be inserted consecutively in all the slots (6) according to a twisting direction.

Figure 3:
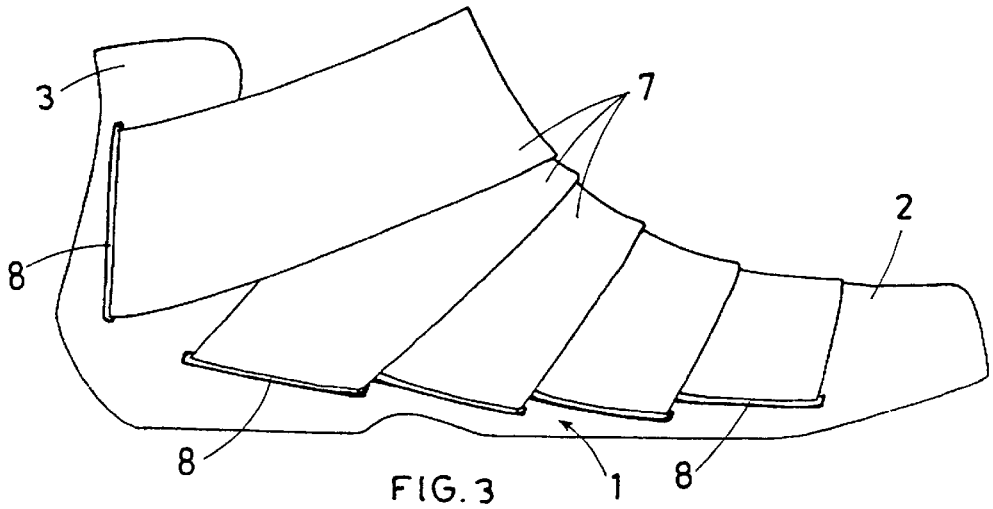
FIG. 3 is a schematic lateral view of the shoe according to the invention in another constructive version, in which the upper is inserted into two opposite series of through openings located on the sole of the bottom and on the body of the heel support.
Figure 4:
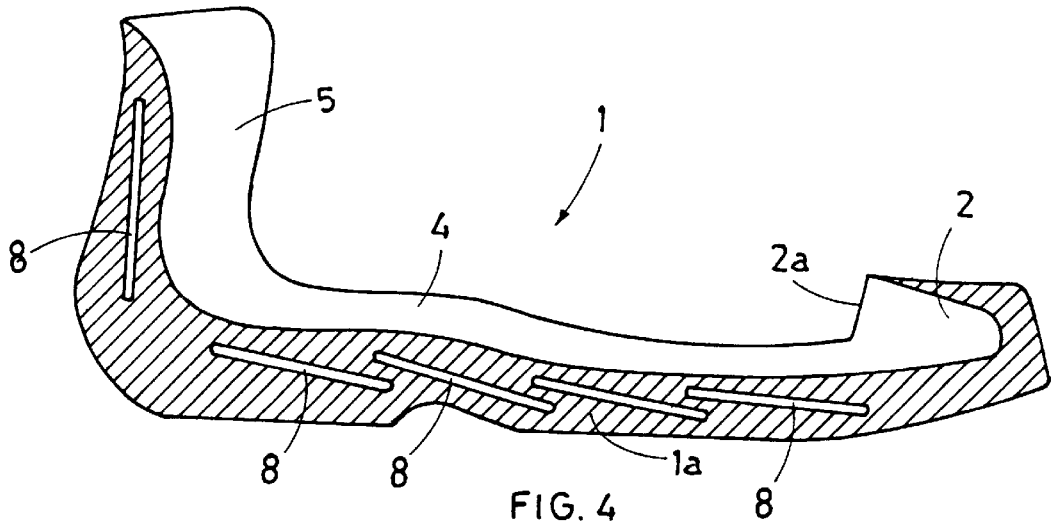
FIG. 4 is a cross-section with a longitudinal plane of the bottom used in the shoe shown in FIG. 3.

With reference to FIGS. 3 and 4, it must be noted that in another constructive version of the shoe according to the invention, the sole **(1*a*) of the bottom (1) and the body of the heel support (3) feature a transverse series of through openings (8) in which the straps (7) are inserted, thus crossing the whole sole (1*a*) of the bottom (1)**, coming out from the sides and being folded upwards and above the foot.

Also in this constructive version the series of through openings (8) are partially overlapped in cascade.

Figure 5:
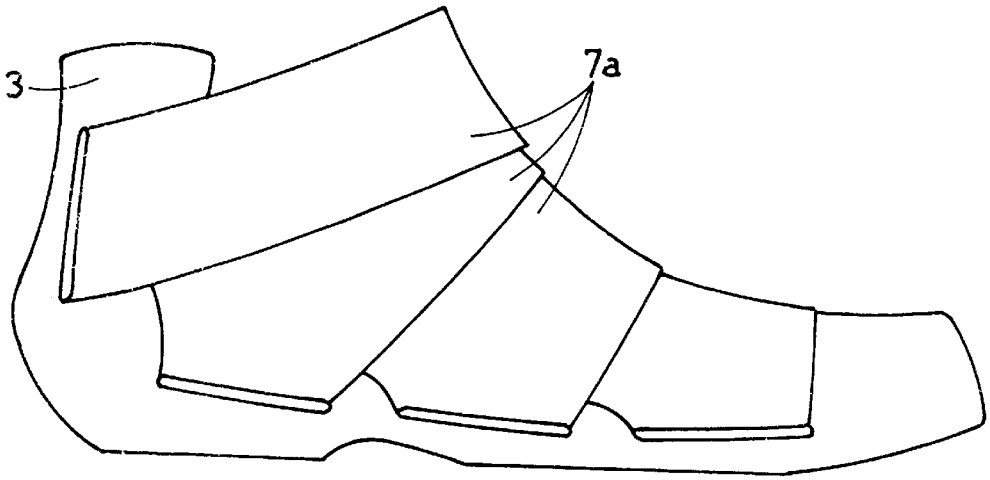
FIG. 5 is a schematic lateral view of the shoe according to the invention in another constructive version, in which the upper into two opposite series of through openings located on the sole of the bottom and the body of the heel support.
Figure 6:
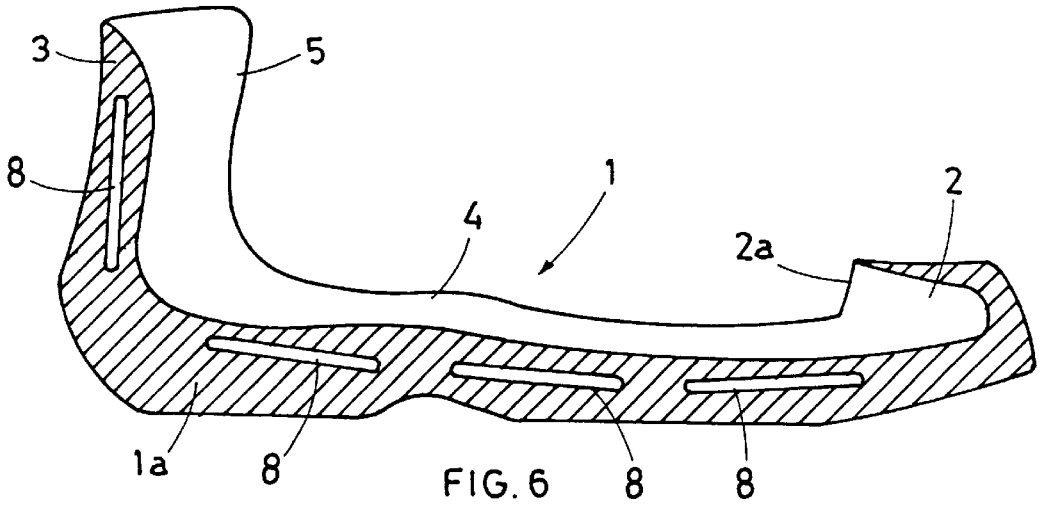
FIG. 6 is a cross-section with a longitudinal plane of the bottom used in the shoe shown in FIG. 5.

FIGS. 5 and 6 illustrate another constructive version of the shoe according to the invention, in which the bottom (1) and the body of the heel support (3) feature a transverse series of through openings (8) in which the straps (7) are inserted, thus crossing the whole sole **(1*a*) of the bottom (1)**, coming out from the sides and being folded upwards and above the foot.

This version only differs from the one shown in FIGS. 3 and 4 for the fact that the series of through openings (8) are not partially overlapped in cascade, but aligned and regularly spaced.

In order to completely cover the foot, in this constructive version the straps **(7*a*)** feature sections with different width, more narrow in the section which is inserted into the openings and wider in the section which embraces the foot.

What is claimed is:

1. A shoe having a molded bottom having a hollow toe portion and a heel support portion, the shoe comprising:

a plurality of spaced-apart elongated openings formed around the bottom, each opening having a width, at least one strap, wherein the at least one strap is received in the respective openings and laced above the molded bottom forming a plurality of partially overlapping straps defining an upper portion such that the shoe may be adapted to be worn by a user with the upper portion covering the foot of the user.

2. The shoe of claim 1, wherein the elongated openings are disposed on the edges of the bottom in a cascade, overlapping arrangement.

3. The shoe of claim 1, wherein the elongated openings are through openings disposed in a cascade, overlapping arrangement.

4. The shoe of claim 1, wherein, the elongated openings are through openings disposed in an aligned, non-overlapping arrangement.

5. A shoe having a molded bottom provided with a series of openings for the application of a closed upper, characterised in that it comprises:

a moulded bottom (1), which features a hollow point (2), a heel support (3) and a series of through openings (8), located in cascade arrangement on the sole **(1*a*) of the bottom (1) a through opening located and on the body of the heel support (3)**, each through opening having a respective width;

an upper made up of at least one strap (7), the at least one strap overlapping itself to form the upper, wherein the plurality of spaced-apart openings are disposed between the hollow toe portion and the heel portion, a first elongated opening being adjacent to the hollow toe portion such that the at least one strap disposed in the first elongated opening covers an opening to the hollow toe.

6. A shoe having a molded bottom having a hollow toe portion and a heel support portion, the shoe comprising:

at least one strap, the strap having a width, the bottom having openings selected from the group consisting of:

1) a plurality of spaced-apart elongated openings formed around the edges of the bottom, the openings being in a cascade, overlapping arrangement, 2) a plurality of spaced-apart elongated through openings formed in the bottom, the openings being in a cascade, overlapping arrangement, and 3) a plurality of spaced-apart elongated through openings formed in the bottom, the openings being disposed in an aligned, non-overlapping arrangement, the plurality of spaced-apart openings being between the hollow toe portion and the heel portion, and the at least one strap being received sequentially in the respective openings and laced above the bottom forming a plurality of partially overlapping straps defining a covered upper portion.

* * * * *